US006941585B2

(12) United States Patent
Wells, Jr.

(10) Patent No.: US 6,941,585 B2
(45) Date of Patent: Sep. 13, 2005

(54) BALLISTIC PROTECTION APPARATUS

(76) Inventor: James D. Wells, Jr., 3473 Exmouth La., Tallahassee, FL (US) 32317

( * ) Notice: Subject to any disclaimer, the term of this patent is extended or adjusted under 35 U.S.C. 154(b) by 0 days.

(21) Appl. No.: 10/625,417

(22) Filed: Jul. 23, 2003

(65) Prior Publication Data

US 2004/0083525 A1 May 6, 2004

Related U.S. Application Data

(60) Provisional application No. 60/398,420, filed on Jul. 25, 2002.

(51) Int. Cl.[7] ..... A41F 15/00; F41H 1/02

(52) U.S. Cl. ..... 2/338; 2/2.5; 2/311

(58) Field of Search ..... 2/1, 338, 337, 2/318, 319, 320, 311, 255, 465, 2.5, 920; 89/36.05

(56) References Cited

U.S. PATENT DOCUMENTS

| | | | | | |
|---|---|---|---|---|---|
| 1,003,270 | A | * | 9/1911 | Keill | 2/2.5 |
| 1,642,046 | A | * | 9/1927 | Sauer | 2/320 |
| 1,756,448 | A | * | 4/1930 | Bigney | 2/338 |
| 2,009,325 | A | * | 7/1935 | Sachs | 2/301 |
| 2,090,442 | A | * | 8/1937 | Epstein | 112/418 |
| 2,124,210 | A | * | 7/1938 | Prindle | 428/102 |
| 2,513,886 | A | * | 7/1950 | Mix | 2/338 |
| 2,790,973 | A | * | 5/1957 | Lewis Jr. et al. | 2/2.5 |
| 3,908,571 | A | * | 9/1975 | Motsenbocker | 112/441 |
| 4,498,201 | A | | 2/1985 | Carter | |
| 4,525,875 | A | * | 7/1985 | Tomczak | 2/463 |
| 4,686,710 | A | * | 8/1987 | Marston et al. | 2/468 |
| 4,864,698 | A | | 9/1989 | Brame | |
| 4,941,237 | A | * | 7/1990 | Hovis | 24/304 |
| 4,999,853 | A | | 3/1991 | Tanner | |
| 5,012,543 | A | | 5/1991 | Lewis, Sr. | |
| 5,016,291 | A | | 5/1991 | Capper | |
| 5,063,643 | A | | 11/1991 | Siegel | |
| 5,086,758 | A | | 2/1992 | Schiek, Sr. et al. | |
| 5,289,619 | A | | 3/1994 | Pileggi | |
| 5,309,575 | A | | 5/1994 | Lookhoof | |
| 5,315,716 | A | | 5/1994 | Baum | |
| 5,463,929 | A | | 11/1995 | Mejia | |
| 5,638,550 | A | | 6/1997 | Hube | |
| 5,758,366 | A | | 6/1998 | Wilson | |
| 5,797,140 | A | | 8/1998 | Davis et al. | |
| 5,819,320 | A | | 10/1998 | Jolla | |
| 5,867,836 | A | | 2/1999 | Quiñones | |
| D408,116 | S | | 4/1999 | Gale | |
| 5,941,186 | A | * | 8/1999 | Argentino | 112/441 |
| 5,970,526 | A | | 10/1999 | Weathers | |
| 5,974,585 | A | | 11/1999 | Bachner, Jr. | |
| 6,108,819 | A | | 8/2000 | DeBaene et al. | |
| 6,185,745 | B1 | | 2/2001 | Alger | |
| D450,909 | S | | 11/2001 | Ellis | |
| 6,389,605 | B2 | | 5/2002 | Srivastava | |
| 6,701,534 | B2 | | 3/2004 | Guibord | |
| 2002/0074185 | A1 | * | 6/2002 | Colorado | 182/6 |

OTHER PUBLICATIONS

"Ballistic Resistant Protective Materials," NIJ Standard 0108.01, U.S. Dept. of Justice, National Institute of Justice Technology Assessment Program, Sep. 1985.

"Ballistic Resistance of Police Body Armor," NIJ Standard 0101.03, U.S. Dept. of Justice, National Institute of Justice, Apr. 1987.

"Selection and Application Guide to Personal Body Armor," NIJ Guide 100–01 (Update to NIJ Guide 100–98), U.S. Dept. of Justice, Office of Justice Programs, National Institute of Justice, Nov. 2001.

Military Buckles, www.pursefactory.com/buckles/military–buckles/military–buckles–2–10.jpg web page (1 sheet), Oct. 24, 2003.

www.strapworks.com/militarybuckle.jpg web page (1 sheet), Oct. 24, 2003.

Second Chance Body Armor brochure, 1999; front cover, pp. 1–7, 20, 27, 32 and back cover.

Ord Arm Sam Brown belt, www.ordarm.com/BallisticSam-Brown.html; web order page (2 sheets), Oct. 14, 2003.

* cited by examiner

*Primary Examiner*—Rodney M. Lindsey
(74) *Attorney, Agent, or Firm*—Baker & Daniels LLP

(57) ABSTRACT

A ballistic protection apparatus including a garment made of ballistic material including a reinforced peripheral edge.

24 Claims, 8 Drawing Sheets

BALLISTIC PROTECTION APPARATUS

CROSS-REFERENCE TO RELATED APPLICATION

This application claims the benefit of U.S. Provisional Application Ser. No. 60/398,420, filed Jul. 25, 2002, the disclosure of which is expressly incorporated herein by reference.

BACKGROUND AND SUMMARY OF THE INVENTION

The present invention relates generally to a belt retention system for garments. More particularly, the invention relates to a belt retention system including a belt and a coupler configured to releasably secure the belt around a person's waist without requiring the use of belt loops.

The present invention further relates to a ballistic edge system associated with the peripheral edge of a garment and configured to provide roll protection to the peripheral edge of the garment.

The present invention also relates to a ballistic belt including a protective cover surrounding a ballistic material.

The present invention further relates to a belt closure system configured to releasably secure together opposing ends of a belt.

According to an illustrative embodiment of the invention, a belt retention system includes a garment configured to be received on the body of a person, a belt configured to support a plurality of accessories, a first coupler secured to the garment, and a second coupler secured to the belt and configured to releasably couple with the first coupler for securing the belt to the garment. Illustratively according to the embodiment, the garment includes a waistband and an adjustment device operably coupled to the waistband and configured to adjust the waistband to a plurality of different sizes. Further illustratively, the adjustment device comprises a hook and loop fastener coupled to the waistband and which is configured to adjust the waistband to a plurality of different sizes.

Further illustratively according to the embodiment, the first coupler comprises one of a hook portion and a loop portion of a hook and loop fastener, and the second coupler comprises the other of the hook portion and the loop portion of the hook and loop fastener.

Illustratively according to the embodiment, the belt retention system further comprises a belt closure system coupled to the belt and including a first securing member configured to releasably couple with a second securing member. The first securing member includes a body configured to receive a first end of the belt, a lock supported by the body and configured to secure the belt to the body, and a hook supported by the body and configured to couple with the second securing member. The second securing member includes a frame configured to be supported proximate a second end of the belt and a support bar coupled to the frame and configured to receive the hook of the first securing member.

Illustratively, the garment may comprise any suitable garment having a portion positioned adjacent the waist of a person, including but not limited to: pants, shorts, coveralls, overalls, dresses, skirts, kilts or skorts, bathing suits, and wet suits.

In a further illustrative embodiment of the invention, a belt retention system includes a belt configured to couple to a garment, a first coupler configured to be secured to an outer surface of the garment, and a second coupler secured to the belt and configured to releasably attach to the first coupler. Illustratively, the garment includes a waistband and an adjustment device operably coupled to the waistband and configured to adjust the waistband between a plurality of sizes. The adjustment device illustratively comprises a hook and loop fastener coupled to the waistband and configured to adjust the waistband to a plurality of different sizes.

Illustratively according to the embodiment, the first coupler comprises one of a hook portion and a loop portion of a hook and loop fastener, and the second coupler comprises the other of the hook portion and the loop portion of the hook and loop fastener. Illustratively, the first coupler may comprise either a continuous strip of loop portion of the hook and loop fastener, or a plurality of non-continuous loop portions of the hook and loop fastener. Further illustratively, the second coupler comprises a hook portion of the hook and loop fastener.

According to a further illustrative embodiment of the present invention, a ballistic protection apparatus includes a garment made of ballistic material including a peripheral edge and configured to be received on the body of a person, and a reinforcing member secured proximate to the peripheral edge of the garment and configured to provide roll protection to the peripheral edge of the garment in response to impact from a projectile. The reinforcing member illustratively comprises a body being substantially more rigid than the garment.

Further illustratively according to the embodiment, the garment may comprise a ballistic belt, a ballistic vest or any other article affixed to, worn over, or worn on the human body. The reinforcing member may be applied to any suitable application for which flexible or soft ballistic material is specified. This could include applications beyond those worn on or over the body including, but not limited to: vehicle/vessel/aircraft armor, ballistic shields and bomb/explosive blast mats.

In a further illustrative embodiment of the invention, a ballistic belt comprises a central portion of ballistic material having a first stiffness, and upper and lower edge portions of ballistic material having a second stiffness and coupled to the central portion. The second stiffness is greater than the first stiffness. Illustratively, the upper and lower edge portions each comprises a body secured to the central portion.

In yet another illustrative embodiment, a ballistic belt comprises a central portion of ballistic material, upper and lower edge portions coupled to the central portion, and a protective cover substantially surrounding the central portion and the upper and lower edge portions. Illustratively, a releasable fastener is supported by the protective cover and is configured to operably couple with a garment to releasably secure the ballistic belt to the garment.

According to a further illustrative embodiment of the invention, a belt closure system includes a belt having opposing first and second ends, a first securing member including a body configured to be supported proximate the first end of the belt, a lock supported by the body and configured to secure the belt to the body, and a hook supported by the body. The belt closure system further includes a second securing member including a frame configured to be supported proximate the second end of the belt and configured to receive the hook of the first securing member to allow the first end of the belt to be releasably secured to the second end of the belt. This belt closure system is applicable to belts made of any suitable material. For example, the belt may include, but is not limited to, leather, cloth, braided rope or other suitable material whether woven or non-woven.

Additional features and advantages of the present invention will become apparent to those skilled in the art upon consideration of the following detailed description when taken in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
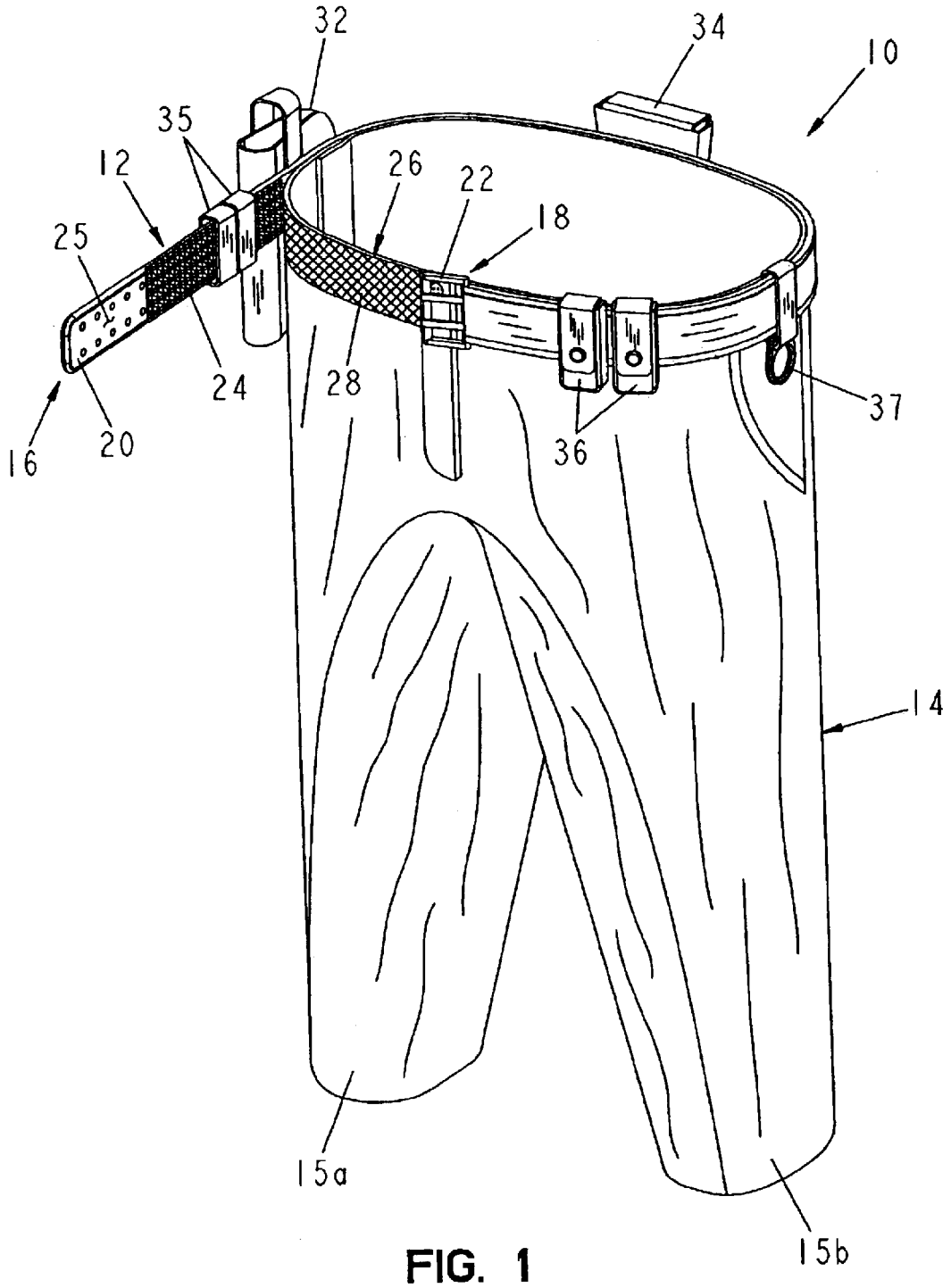
FIG. 1 is a perspective view of an illustrative embodiment belt retention system of the present invention, illustrating the belt retention system including a belt partially attached to a garment.

FIG. 1 illustrates a belt retention system 10 according to an illustrative embodiment of the invention as comprising a belt 12 and a garment 14, illustratively pants. The belt 12 comprises a first end 16 and a second end 18 configured to be selectively spaced apart or releasably secured together in a conventional manner. More particularly, the first end 16 includes a tongue portion 20 and the second end 18 includes a buckle portion 22. A first inner securing surface or first coupler 24 is secured to an inner surface 25 of the belt 12 in a suitable manner, for example by stitching or through any other similar means, including riveting or adhesives. The garment 14 illustratively includes a pair of leg portions 15*a* and 15*b* extending downwardly from a waistband 26. An outer securing surface or second coupler 28 is secured to an outer surface 27 of the waistband 26 by stitching, adhesives, or other suitable means. The second coupler 28 is configured to releasably attach to the first coupler 24 of the belt 12 thereby releasably securing the belt 12 to the waistband 26. Illustratively, the first coupler 24 comprises the loop portion of a conventional releasable hook and loop fastener, while the second coupler 28 comprises the mating hook portion of the hook and loop fastener.

Figure 2:
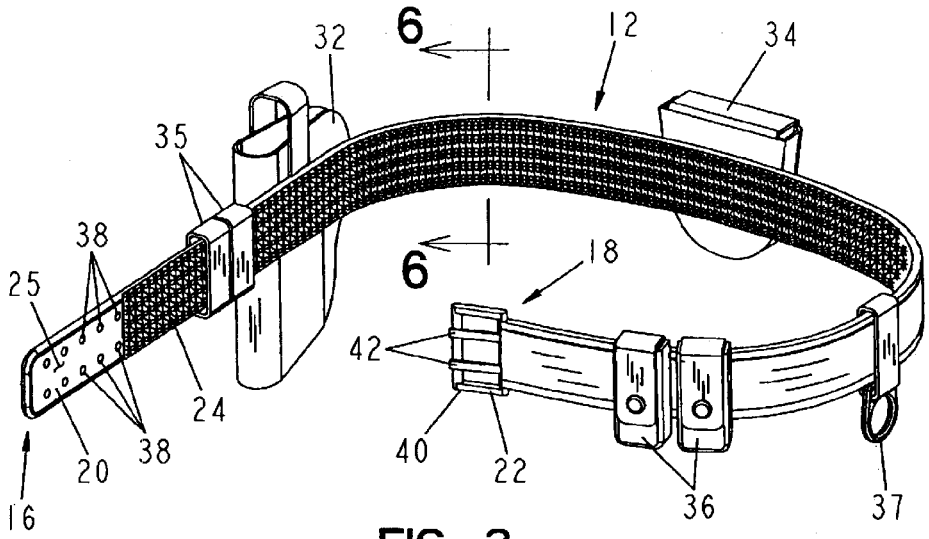
FIG. 2 is a perspective view illustrating the belt and the first coupler of the belt retention system of FIG. 1.

FIG. 2 illustrates the first coupler 24 as extending continuously along the entire inner surface 25 of the belt 12 with the exception of the tongue portion 20 and the buckle portion 22. It may be appreciated that the first coupler 24 need not extend continuously along the entire inner surface 25 and may alternatively comprise a plurality of individual spaced-apart portions positioned at various locations along the inner surface 25. While the belt portion 12 may be made of patent leather to give a glossy appearance, it may alternatively be formed of any other suitable material including soft armor, ballistic, or bullet-resistant material as described in greater detail below. As shown in FIGS. 1 and 2, the belt 12 is a utility belt and is illustratively configured to support a plurality of accessory holders such as a gun holster 32, a handcuff holder 34, grips 35, ammo pouches 36, and a key ring 37. The grips 35 illustratively comprise loops extending around the belt 12 and including a conventional quick release mechanism, such as snaps 39 (FIG. 13), configured to hold accessories, such as handcuffs or flashlights. It should be appreciated that additional or alternate accessory holders may likewise be supported by the belt 12 in a suitable manner. The accessory holders 32, 34, 35, 36 and 37 may be secured to the belt 12 by suitable means, for example by loops wrapping around the belt 12, rivets passing into the belt 12, adhesives applied to the belt 12 and/or stitches engaging the belt 12.

Referring further to FIG. 2, the tongue portion 20 is composed of two vertically spaced rows of holes 38 which are longitudinally spaced apart, in a lengthwise direction of the belt 12, to allow for size adjustment of the belt 12. The buckle portion 22 includes a frame 40 pivotally supporting a pair of prongs or tangs 42 of conventional design. The holes 38 are positioned to slidably receive the tangs 42 to allow for fastening of the tongue portion 20 of the belt 12 to the buckle portion 22 of the belt 12. The belt retention system 10 is capable of utilizing any suitable belt fastener or coupling substituted in place of the tongue portion 20 and buckle portion 22 in order to secure the first end 16 of the belt 12 to the second end 18 of the belt 12.

Figure 3:
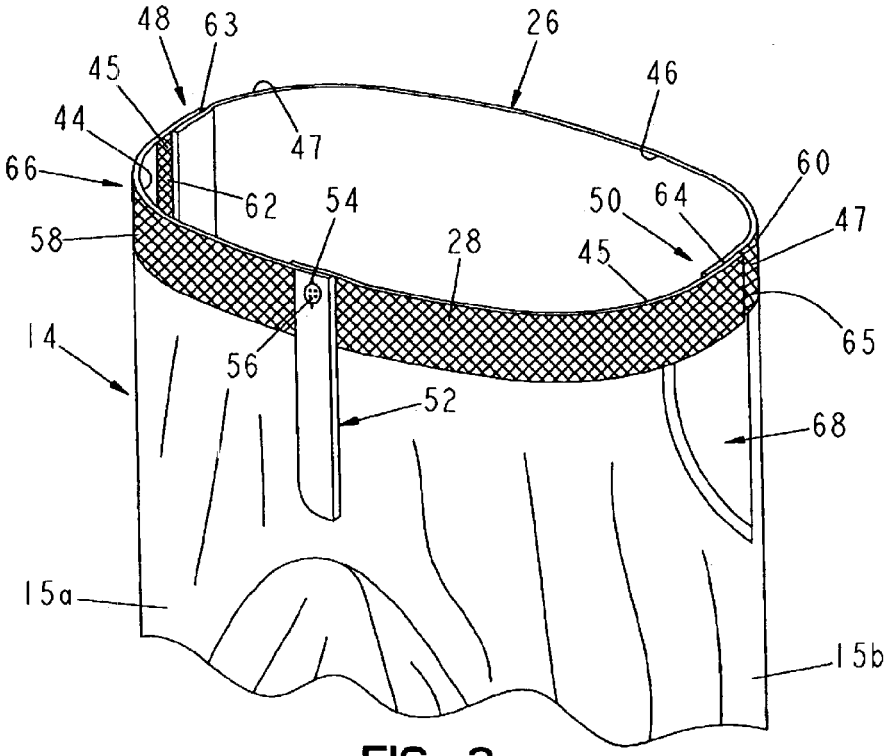
FIG. 3 is a perspective view illustrating the garment and the second coupler of the belt retention system of FIG. 1, along with a waistband and an adjustment device in accordance with the illustrative embodiment of the present invention.

FIG. 3 illustrates the garment 14 including the outer securing surface 28 that is secured to garment 14 by any suitable means of attachment. The waistband 26 of the garment 14 includes a front band 44 and a rear band 46 separated by first and second waistband adjustment devices 48 and 50. Garment 14 may include a conventional fly 52 passing through the front band 44, and a slit or hole 54 cooperating with a fastener 56 to close and secure an upper portion of the fly 52. A conventional zipper or buttons (not shown) may be used to close and secure the remainder of the fly 52. The second coupler 28 includes a front second coupler portion 58 secured to the front band 44, and a rear second coupler portion 60 secured to the rear band 46.

Figure 4:
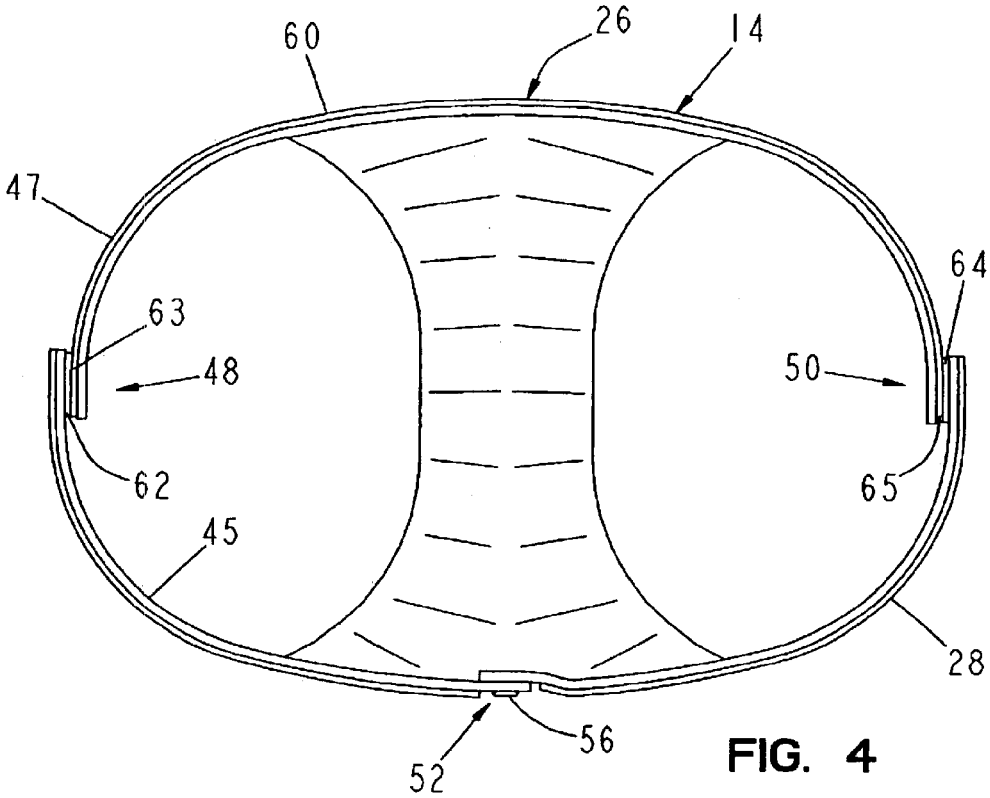
FIG. 4 is a top plan view illustrating the waistband and the adjustment device of the garment of FIG. 3, showing the waistband in a first waistband adjustment size.
Figure 5:
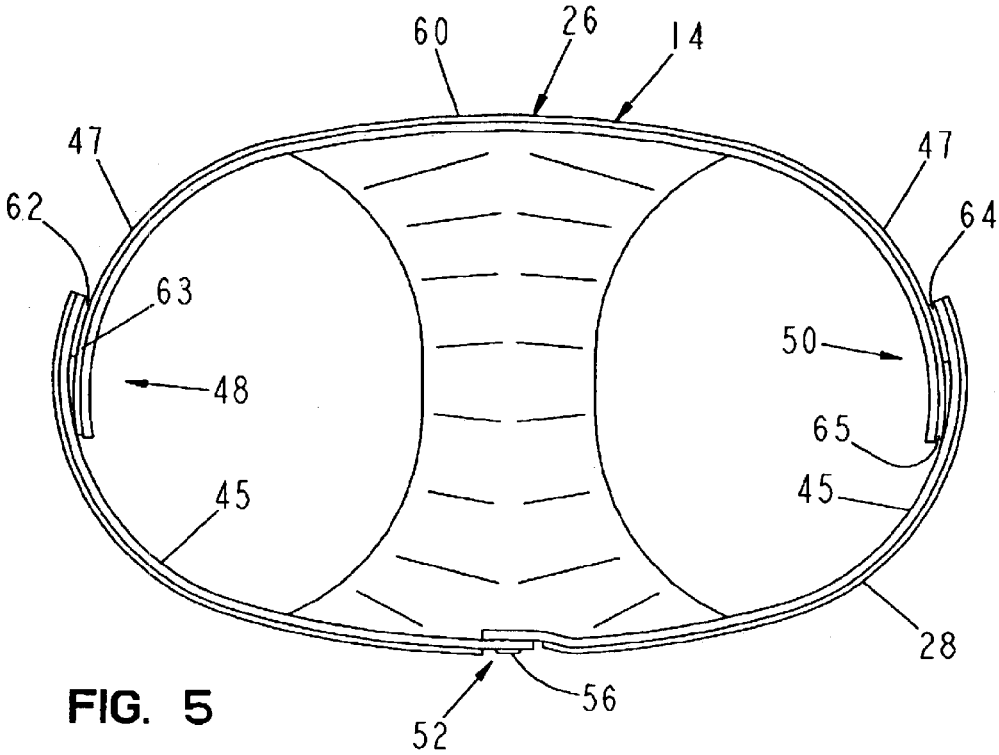
FIG. 5 is a top plan view similar to FIG. 4, illustrating the waistband in a second waistband adjustment size smaller than the first waistband adjustment size shown in FIG. 4.

As shown in FIGS. 3, 4 and 5, each of the first and second adjustment devices 48 and 50 include an adjustment coupler 62 and 64 configured to an inner surface 45 of the front band 44 to an overlapping portion of an outer surface 47 of the rear band 46. More particularly, the adjustment couplers 62 and 64 are removably attachable to opposing portions 63 and 65 of the rear second coupler portion 60 to adjust the waistband 26 for different sizes. As such, the adjustment couplers 62 and 64 illustratively comprise loop portions of a hook and loop fastener configured to releasably couple with the hook portion of the rear second coupler portion 60 secured to the waistband 26. FIG. 4 shows a first waistband size and FIG. 5 shows a second waistband size smaller than the first waistband size of FIG. 4. Pockets 66 and 68 in the garment 14 (FIG. 3) illustratively overlap and are configured to spread out or separate based on the size adjustment of the waistband 26.

FIG. 1 further illustrates the belt 12 coupled to the garment 14 to form the belt retention system 10. The belt 12 attaches to the garment 14 by connecting the first coupler 24 to the second coupler 28 in a manner following the shape of the waistband 26. The first end 16 of belt 12 is connectable to the second end 18 by inserting tongue portion 20 into the buckle portion 22 or by alternative coupling as described elsewhere in this disclosure. The waistband 26 is adjustable primarily by using the first and second waistband adjustment devices 48 and 50, shown in FIGS. 4 and 5. More particularly, the adjustment couplers 62 and 64 may be detached, adjusted and then reattached to the end portions 63 and 65 of the rear second coupler portion 60 to provide a proper fit of the waistband 26. The belt 12 may be tensioned like a traditional belt to give additional support.

Figure 6:
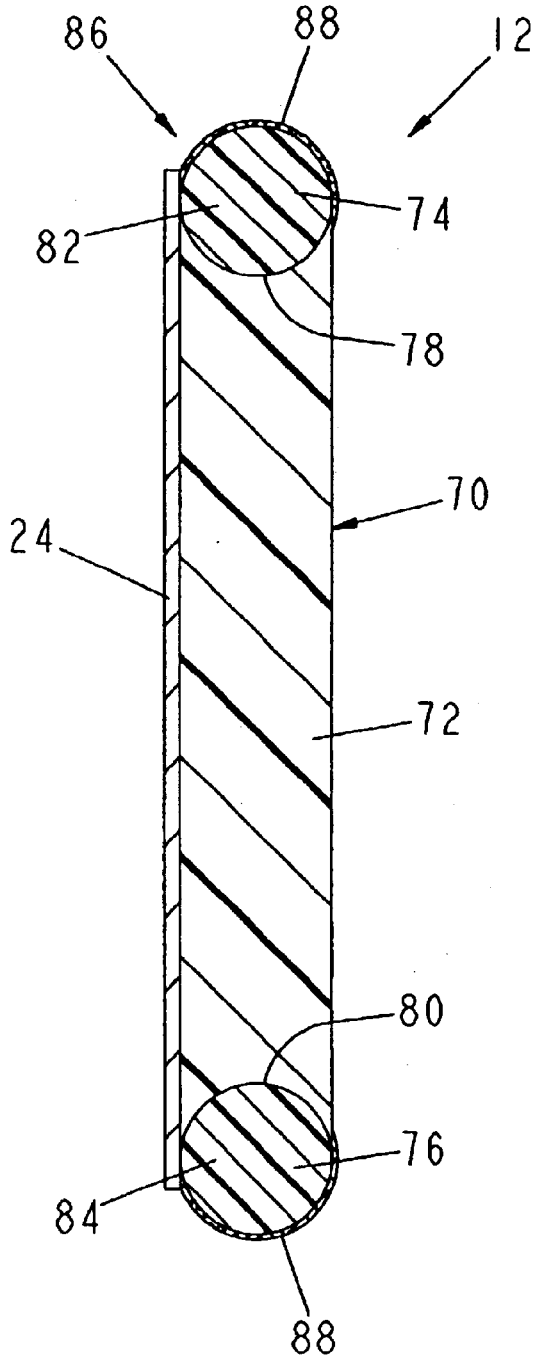
FIG. 6 is a vertical cross-sectional view taken along line 6—6 of FIG. 2, illustrating a ballistic belt including reinforcing edges.
Figure 6A:
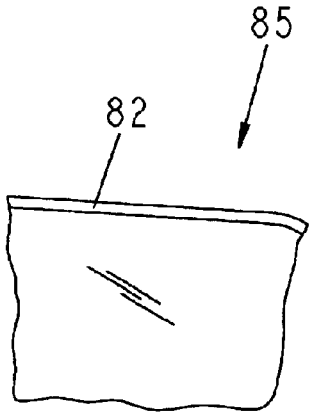
FIG. 6A is a partial top plan view of an illustrative embodiment ballistic vest of the present invention.
Figure 6B:
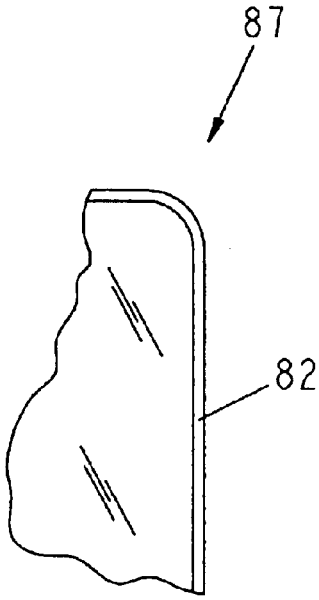
FIG. 6B is a partial top plan view of an illustrative embodiment flexible armor member of the present invention.

FIG. 6 is a cross-sectional view of the illustrative belt 12 including a ballistic insert 70 having a central portion 72 formed of a ballistic material. Opposing upper and lower edge portions 74 and 76 of the belt 12 are formed by a pair of reinforcing members, illustratively ballistic cords 82 and 84 coupled to upper and lower edges 78 and 80 of the central portion 72, thereby defining a ballistic edge reinforcement system 86. While in the present description, the ballistic edge reinforcement system 86 is described in connection with the belt 12, it should be appreciated that the invention may find equal applicability with any article of clothing or article utilizing flexible or soft body armor or ballistic material including, but not limited to, ballistic vests, ballistic pants or any other ballistic garment designed to be worn over the body. A cut-away of an illustrative ballistic vest 85 including a reinforcing member, such as ballistic cord 82, is shown in FIG. 6A. Further, the invention may also find applicability with any other flexible or soft armor application in which a reinforced edge is useful, including, but not limited to: vehicle/vessel/aircraft armor, ballistic shields or bomb/explosive blast mats. A cut-away of an illustrative flexible armor member 87 including a reinforcing member, such as ballistic cord 82, is shown in FIG. 6B.

Figure 11:
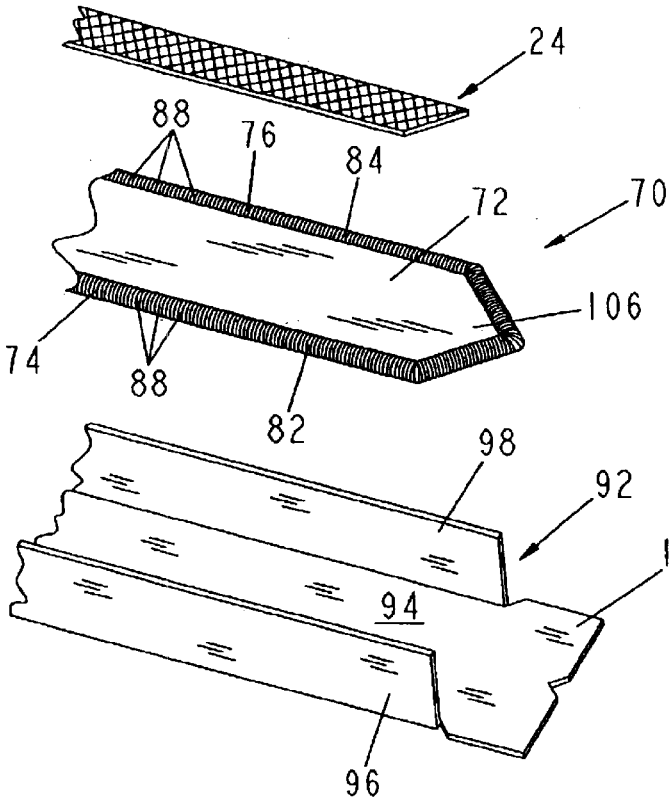
FIG. 11 is an exploded perspective view of the ballistic belt of FIG. 10.

The ballistic cords 82 and 84 are attached proximate the peripheral edges 78 and 80 of the central portion 72 in any conventional manner including, but not limited to, the following: stitching, riveting, or gluing. As illustrated in FIGS. 6 and 11, the ballistic cords 82 and 84 are secured to the central portion 72 by overstitches 88 which pass around the outer edges of the respective cords 82 and 84 and through the central portion 72. The ballistic cords 82 and 84 may also be formed integral with the central portion 72 such as by rolling the edges of the central portion 72 and thereby making the ballistic edge system 86 a single integral unit.

Illustratively, the cords 82 and 84 are formed to have a stiffness greater than that of the central portion 72. In one embodiment, the material of the cords 82 and 84 is selected to have a modulus of elasticity greater than the modulus of elasticity of the central portion 72. Alternatively, the thickness of the cords 82 and 84 may be greater than that of the central portion 72 in order to provide for increased stiffness over the central portion 72. Finally, the material fibers in the cords 82 and 84 may be oriented in such a manner so as to provide a stiffness greater than that of the central portion 72. The ballistic edge reinforcement system 86 may take other suitable forms including, but not limited to, specially woven edges or selvedges, ballistic material stitches sewn to the edges, or other means of stiffening including, but not limited to, bonding materials.

Figure 7:
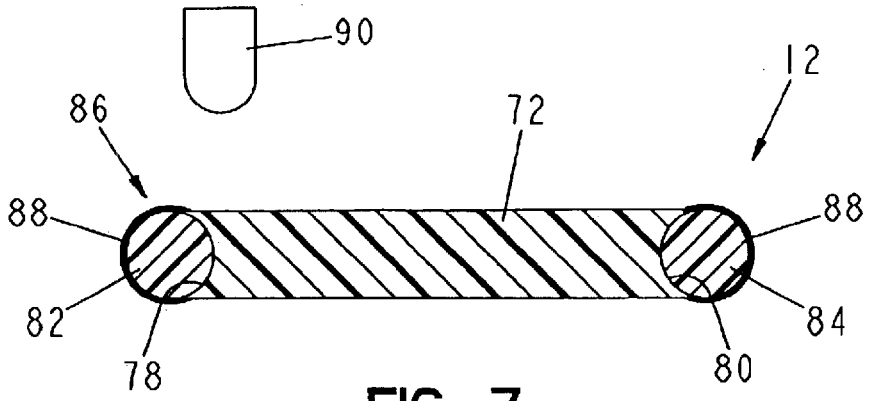
FIG. 7 is a cross-sectional view in partial schematic of the ballistic belt of FIG. 6, showing an approaching bullet.
Figure 8:
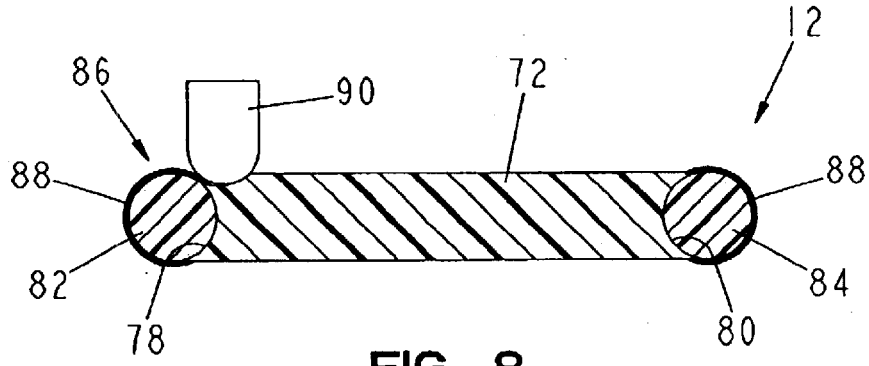
FIG. 8 is a cross-sectional view in partial schematic of the ballistic belt of FIG. 6, showing the bullet making contact with the belt.
Figure 9:
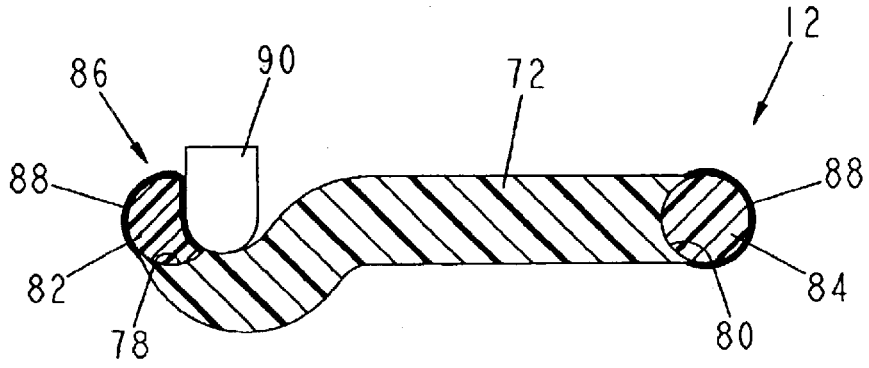
FIG. 9 is a cross-sectional view in partial schematic of the ballistic belt of FIG. 6, showing the reaction of the roll-resistant reinforcing edge as the bullet makes full contact with the belt.

FIGS. 7, 8 and 9 schematically illustrate the ballistic edge system 86 in operation. FIG. 7 shows a projectile 90, such as a bullet, approaching the ballistic edge system 86. Shown in FIG. 8, the projectile 90 makes contact with the ballistic edge system 86 proximate the ballistic cord 82.

Traditionally, a ballistic material prevents the penetration of the projectile 90 through the material and into the body of a person. A traditional ballistic material does not have a suitable edge reinforcement. As such, when the projectile 90 strikes the edge of the ballistic material, it tends to roll the ballistic material and may allow the projectile 90 to penetrate the person. With the addition of the ballistic cord 82, or other suitable edge reinforcement, when the projectile 90 contacts the ballistic material, in the form of the central portion 72 of the belt 12 in FIGS. 7–9 (or other garment in further illustrative embodiments of the ballistic material), the ballistic cord 82, or other suitable edge reinforcement, prevents the rolling of the central portion 72 of ballistic material about the peripheral edge 78 in the direction of impact from the projectile 90.

FIG. 9 shows the ballistic cord 82 (or other suitable edge reinforcement) preventing the rolling of the edge 78 of the central portion 72 of the belt 12, but still allowing the central portion 72 of ballistic material to flex and prevent the projectile 90 from penetrating the person. In FIG. 9, the projectile 90 is essentially captured between the central portion 72 and the ballistic cord 82. It should be appreciated that the ballistic cord 82 may be placed around every outer or peripheral edge of any ballistic garment or protective article.

Each ballistic cord 82 and 84 (or other suitable edge reinforcement) is illustratively made to be substantially more rigid than the material of the ballistic garment, which prevents the rolling of the edge of a ballistic garment. Both the belt 12 and the ballistic cord 82 and 84 may be formed of any suitable ballistic material such, as but not limited to, an aramid fiber or thread, as for example polyparaphenylene terephthalamide, commonly referred to as Kevlar®, available from DuPont Advanced Fiber Systems of Richmond, Va. Another suitable material may comprise an extended chain polyethylene thread of fiber, for example Spectra polyethylene fibers.

Figure 10:
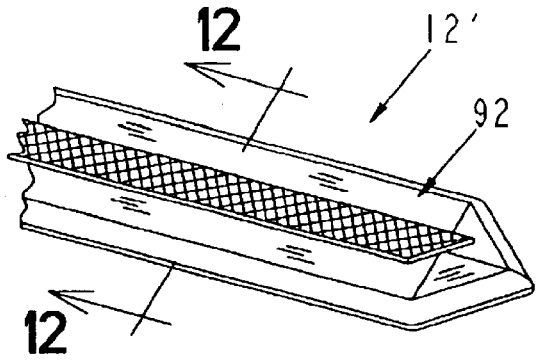
FIG. 10 is a partial rear perspective view of a further illustrative embodiment ballistic belt of the present invention, showing a cover surrounding the ballistic material.
Figure 12:
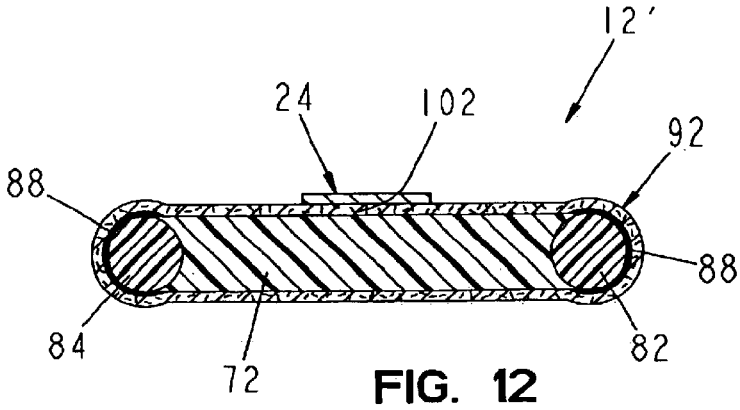
FIG. 12 is a cross-sectional view taken along line 12—12 of FIG. 10.

As illustrated in FIGS. 10–12, an outer cover 92 may surround the ballistic insert 70 of the alternative embodiment belt 12' including the central portion 72 and the upper and lower edge portions 74 and 76. The outer cover 92 is configured to protect the integrity of the ballistic insert 70 by preventing the fraying thereof. The outer cover 92 also prevents dirt, debris and moisture from contacting and contaminating the ballistic insert 70.

With reference to FIGS. 11 and 12, the cover 92 comprises a single body including a longitudinally extending base 94 and opposing first and second side portions 96 and 98 extending outwardly from the base 94. The first and second side portions 96 and 98 are configured to wrap around the opposing edge portions 74 and 76 of the ballistic insert 70. The side portions 96 and 98 cover a rear surface 100 of the ballistic insert 70 and define a seam 102 therebetween. An end portion 104 extends outwardly from the base 94 and is configured to wrap around a tapered end 106 of the ballistic insert 70 as illustrated in FIG. 10. The first coupler 24 is secured to the cover 92 and extends substantially parallel to the seam 102. As such, the first coupler 24 hides the seam 102. In one illustrative embodiment, each of the first and second side portions 96 and 98 are secured to the first coupler 24, thereby securing the cover 92 around the ballistic insert 70. The cover 92 may be formed of any flexible material including, but not limited to, leather, polyurethane, or woven materials, such as ballistic nylon.

Figure 13:
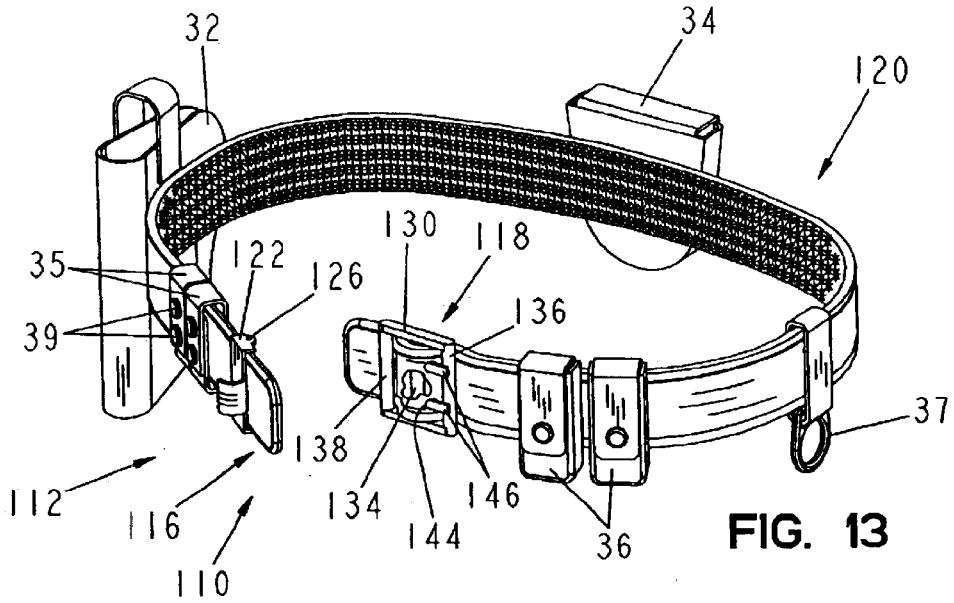
FIG. 13 is a perspective view of an alternative illustrative embodiment of the belt closure system of the belt retention system of FIG. 1.
Figure 14:
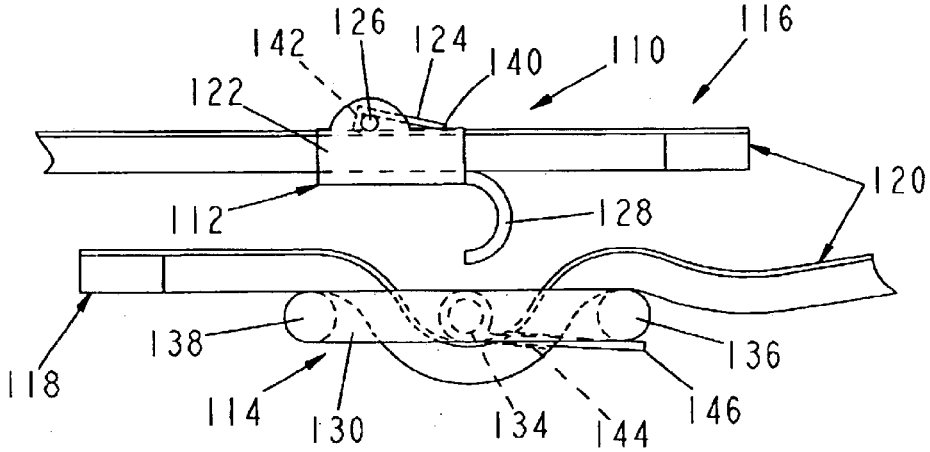
FIG. 14 is a top plan view of the belt closure system of FIG. 13.
Figure 15:
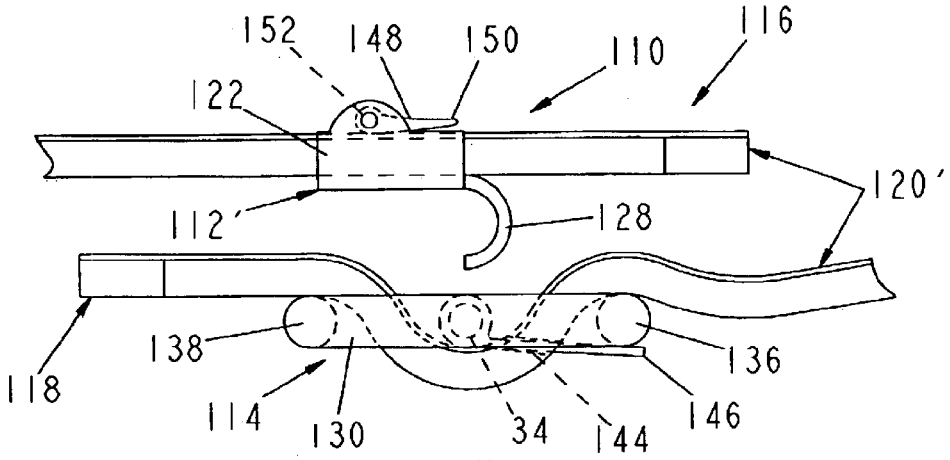
FIG. 15 is a top plan view of an alternative illustrative embodiment of the belt closure system of FIG. 13.

FIGS. 13, 14, and 15 show a belt closure system 110 comprising a first securing member 112 configured to releasably attach to a second securing member 114 for securing together opposing first and second ends 116 and 118 of a belt 120. The first securing member 112 includes body 122 configured to receive, and be supported proximate, the first end 116 of the belt 120. A lock, in the form of an L-shaped bracket 124 (FIG. 14) is supported for pivoting movement by the body 122 through a hinge or pivot 126. The bracket 124 is configured to releasably secure the body 122 to the first end 116 of the belt 120. A J-shaped hook 128 is supported by the body 122 and is configured to operably couple with the second securing member 114. The second securing member 114 includes a frame 130, a pair of tangs 146 pivotably supported by the frame 130, and a support bar or center vertical member 134 coupled to the frame 130. Frame 130 further comprises a first outer vertical member 136 and a second outer vertical member 138.

Bracket 124 has a gripping portion 140 configured to be gripped by a user, and a locking portion 142 that moves about pivot 126 to clamp against the belt 120. First securing member 112 moves freely along belt 120 when L-shaped bracket 124 is not engaged. When L-shaped bracket 124 is engaged, the locking portion 142 is in contact with belt 120 and prevents motion of the first securing member 112. FIG. 14 further shows the detail of the second securing member 114. The second end 118 of belt 120 runs under the first outer vertical member 136 over the support bar 134 and under the second outer vertical member 138. The belt 120 further includes holes 144 positioned to receive tangs 146 to secure the second securing member 114 to belt 120. To engage the belt closure system 110 and secure the ends 116 and 118 of the belt 120, the J-shaped hook 128 engages with support bar 134. The belt closure system 110 is shown in FIG. 13 on a ballistic belt but it is adaptable to any belt where a traditional buckle would suffice.

FIG. 15 illustrates an alternative embodiment belt 120' including a first securing member 112'. The first securing member 112' of FIG. 15 is substantially identical to the first securing member 112 of FIG. 14 but for the lock supported by the body 122. More particularly, the lock of the first securing member 112' comprises a cam 148 including a gripping portion 150 configured to be gripped by a user, and a locking portion 152 supported for pivoting movement in order to secure the body 122 to the belt 120' in similar fashion to the L-shaped bracket 124 identified above.

By releasing the bracket 124 or the cam 148 from engaging the belt 120 or 120', respectively, the first securing member 112 and 112' may be slidably moved, thereby adjusting the size of the belt 120 and 120'. The locking portions 142 and 152, when oriented as in FIGS. 14 and 15, become more difficult to move as tension between the hook 128 and the center vertical member 134 increases.

Although the invention has been described in detail with reference to certain illustrated embodiments, variations and modifications exist within the spirit and scope of the present invention as described and defined in the following claims.

What is claimed is:

1. A ballistic protection apparatus comprising:

a garment made of ballistic material including a peripheral edge and configured to be received on the body of a person, the ballistic material being configured to resist the penetration of a projectile therethrough into the body of the person; and a reinforcing member secured proximate to the peripheral edge of the garment and configured to provide roll protection to the peripheral edge of the garment in response to impact from a projectile.

2. The apparatus of claim 1, wherein the reinforcing member has a stiffness greater than a stiffness of the garment.

3. The apparatus of claim 2, wherein the reinforcing member comprises a reinforcing cord extending substantially continuously along the peripheral edge.

4. The apparatus of claim 2, wherein the reinforcing member has a modulus of elasticity greater than a modulus of elasticity of the garment.

5. The apparatus of claim 2, wherein the thickness of the reinforcing member is greater than the thickness of the garment.

6. The apparatus of claim 1, wherein the garment comprises one of a ballistic belt and a ballistic vest.

7. The apparatus of claim 1, further comprising an outer cover substantially surrounding the garment and the reinforcing member.

8. The apparatus of claim 1, wherein the garment is formed of polyparaphenylene terephthalamide.

9. A ballistic article comprising:

a flexible armor member including a peripheral edge; and a flexible reinforcing member located proximate the peripheral edge and configured to provide roll protection to the peripheral edge of the flexible armor member in response to impact from a projectile by capturing the projectile between the flexible armor member and the reinforcing member.

10. The ballistic article of claim 9, wherein the flexible armor member is configured for use as one of a vehicle armor, a vessel armor, an aircraft armor, a ballistic shield, a ballistic garment, and an explosive blast mat.

11. The ballistic article of claim 9, wherein the reinforcing member comprises a body having a stiffness greater than a stiffness of the armor member.

12. The ballistic article of claim 11, wherein the reinforcing member comprises a reinforcing cord extending substantially continuously along the peripheral edge.

13. The ballistic article of claim 11, wherein the reinforcing member has a modulus of elasticity greater than a modulus of elasticity of the armor member.

14. The ballistic article of claim 11, wherein the thickness of the reinforcing member is greater than the thickness of the armor member.

15. A ballistic belt comprising:

a central portion of ballistic material having a first stiffness;

upper and lower edge portions of ballistic material having a second stiffness and coupled to the central portion, the second stiffness being greater than the first stiffness; and wherein the ballistic material is configured to resist the penetration of a projectile therethrough.

16. The ballistic belt of claim 15, wherein the upper and lower edge portions each comprises a body secured to the central portion.

17. The ballistic belt of claim 15, wherein the upper and lower edge portions each have a modulus of elasticity greater than a modulus of elasticity of the central portion.

18. The ballistic belt of claim 15, wherein the thickness of each of the upper and lower edge portions is greater than the thickness of the central portion.

19. The ballistic belt of claim 15, further comprising a protective cover substantially surrounding the central portion and the upper and lower edge portions.

20. The ballistic belt of claim 15, further comprising a releasable fastener supported by the central portion and configured to operably couple with a garment to releasably secure the ballistic belt to a garment.

21. A ballistic belt comprising:

a central portion of ballistic material;

upper and lower edge portions coupled to the central portion; and an outer cover substantially surrounding the central portion and the upper and lower edge portions.

22. The ballistic belt of claim 21, wherein the outer cover defines a seam on a rear side of the ballistic belt.

23. The ballistic belt of claim 21, further comprising a releasable fastener supported by the outer cover and configured to operably couple with a garment to releasably secure the ballistic belt to the garment.

24. The ballistic belt of claim 21, wherein the central portion has a first stiffness, and the upper and lower edge portions have a second stiffness, the second stiffness being greater than the first stiffness.

* * * * *